US005195636A

United States Patent [19]

Wridt

[11] Patent Number: 5,195,636

[45] Date of Patent: Mar. 23, 1993

[54] METAL SOCKET TRAY WITH PIVOTING SOCKET RETAINER

[75] Inventor: Gerald A. Wridt, Racine, Wis.

[73] Assignee: Snap-on Tools Corporation, Kenosha, Wis.

[21] Appl. No.: 859,088

[22] Filed: Mar. 27, 1992

[51] Int. Cl.[5] ..... B65D 25/28; B65D 85/00

[52] U.S. Cl. ..... 206/378; 220/760; 220/764; 220/770; 211/70.6

[58] Field of Search ..... 220/759, 760, 764, 770, 220/762, 765; 294/158; 211/69, 70.6; 206/378

[56] References Cited

U.S. PATENT DOCUMENTS

| | | |
|---|---|---|
| 1,869,945 | 8/1932 | Rice . |
| 2,712,915 | 7/1955 | Cohen et al. . |
| 2,925,904 | 2/1960 | Eichholz . |
| 4,119,044 | 10/1978 | Hines . |
| 4,337,751 | 7/1982 | Sampson et al. . |
| 4,714,158 | 12/1987 | Oltman et al. . |
| 4,799,306 | 1/1989 | Collins et al. . |

FOREIGN PATENT DOCUMENTS 598385 5/1960 Canada ..... 211/70.6

OTHER PUBLICATIONS

Snap-on Tools Corporation Drawing No. KTA212F showing socket tray Model KTA212F. May 1984.

Snap-on Tools Corporation Drawing No. KTA231B showing socket tray Model KTA231B. Sep. 1991.

Snap-on Tools Corporation Drawing No. 231BU0101 showing flanged socket tray. Sep. 1991.

Snap-Tools Corporation 1991 catalog p. 41 showing tray Model KTA110T (item J1).

*Primary Examiner*—William I. Price

*Attorney, Agent, or Firm*—Emrich & Dithmar

[57] ABSTRACT

A tray for a set of sockets of varying diameters includes an elongated, open-top, trapezoidal receptacle with upstanding end walls each having an opening therein in the shape of a 270° sector of a circle, with the ends of each sector defining stop surfaces. A bail retainer has an elongated flat bight and depending end portions which respectively extend along the outside of the end walls, and each provided with an inwardly projecting rectangular tab which extends into the asociated opening to form a chord thereof. The retainer is pivotal between a retaining position wherein the bight closely overlies the receptacle to retain the sockets therein and a position alongside the receptacle permitting removal of the sockets from the receptacle, the pivotal movement being limited by the stop surfaces of the openings. An elongated flange depends from one side wall of the receptacle to facilitate hanging on an associated support, such as a tool chest.

20 Claims, 1 Drawing Sheet

METAL SOCKET TRAY WITH PIVOTING SOCKET RETAINER

BACKGROUND OF THE INVENTION

1. Field of the Invention

The present invention relates to open-top trays and receptacles and, in particular, to a pivotal mount for a retainer therefor.

2. Description of the Prior Art

Sets of sockets for use with associated drive members to form socket wrenches, such as ratcheting wrenches or the like, may be stored in trays dimensioned to snugly receive the sockets in an array of decreasing diameters. Such trays may be provided with pivoting retainers which generally define a bail which is pivotally movable between an access position lying alongside the receptacle to permit insertion and removal of sockets, and a retaining position closely overlying the receptacle so as to prevent removal of the sockets from the receptacle. Heretofore, such pivotal retainers have been riveted to upstanding end walls of the receptacle. This riveted construction increases the time and expense of assembly.

SUMMARY OF THE INVENTION

It is a general object of the present invention to provide an improved tray assembly which avoids the disadvantages of prior tray assemblies while affording additional structural and operating advantages.

An important feature of the invention is the provision of a tray assembly with a pivoting retainer which is coupled to the tray receptacle without the use of fasteners.

In connection with the foregoing feature, another feature of the invention is the provision of a tray assembly with a non-riveted pivoting retainer.

Another feature of the invention is the provision of a pivoting retainer which is easily assembled with and removed from the associated tray.

A further feature of the invention is the provision of a first stop surface for the retainer in the access position and a second stop surface in the retaining position without the need for additional parts.

These and other features of the invention are attained by providing a tray assembly for articles comprising: an article receptacle having opposed upstanding end walls, each of the end walls having an opening therein with each of the openings shaped to define first and second stop surfaces, and a bail retainer having end portions respectively disposable along the end walls, each of the end portions having a projection extending therefrom such that the projections are respectively pivotally receivable in the openings for pivotal movement of the retainer between first and second positions, the retainer in its first position closely overlying the receptacle for retaining articles therein with the projections respectively engaged with the first stop surfaces, the retainer in its second position being disposed alongside the receptacle for permitting access to the interior thereof with the projections respectively engaged with the second stop surfaces, the first stop surfaces being positioned relative to the second stop surfaces so as to limit the pivotal movement of the retainer to substantially less than 360°.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
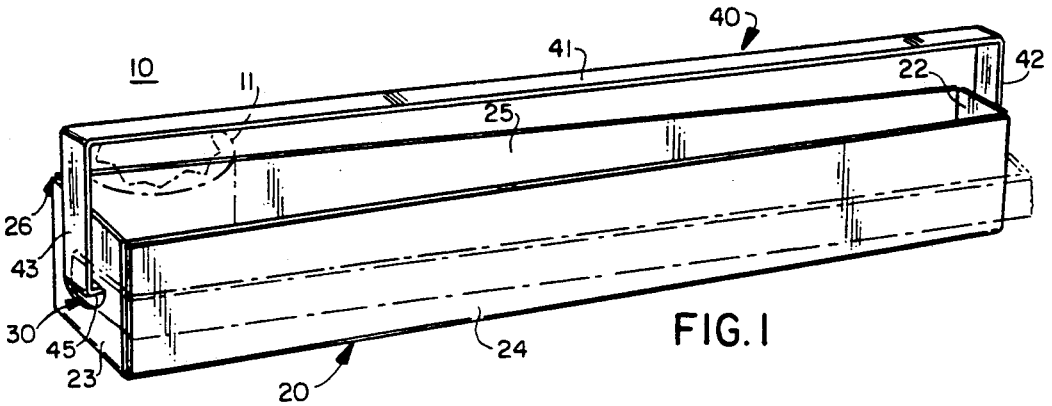
FIG. 1 is a perspective view of a tray assembly constructed in accordance with and embodying the features of the present invention, with a retainer illustrated in solid line in its retaining position and in phantom in its access position.
Figure 2:
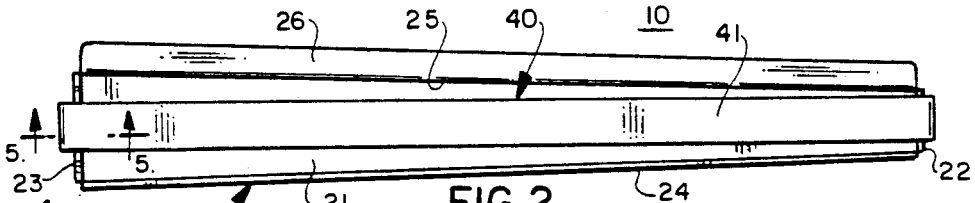
FIG. 2 is a reduced top plan view of the tray assembly of FIG. 1.
Figure 3:
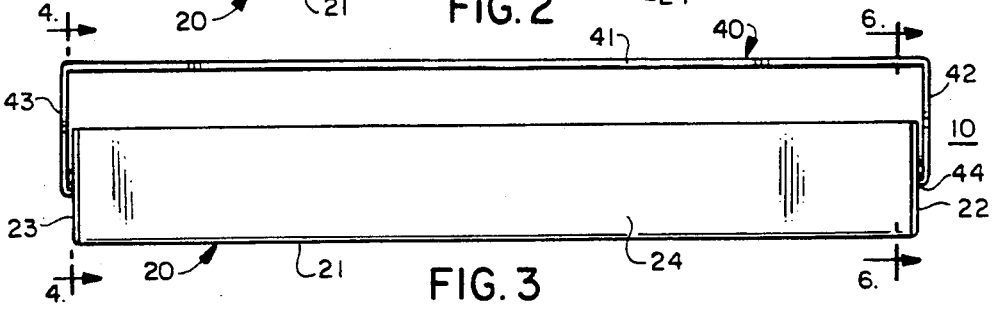
FIG. 3 is a front elevational view of the tray assembly of FIG. 2.

Referring to the drawings, there is illustrated a tray assembly, generally designated by the numeral 10, constructed in accordance with the present invention, and adapted for retaining a plurality of sockets 11 (one shown) of varying diameters. The tray assembly 10 includes an open-top receptacle 20 having a flat, elongated, trapezoidal bottom wall 21, integral along its end edges, respectively, with upstanding end walls 22 and 23, and integral along its side edges, respectively, with upstanding side walls 24 and 25, the walls 21-25 all being interconnected by suitable means. There results, an open-top box with side walls which converge from the end wall 23 to the end wall 22 so as to snugly receive a set of sockets arranged in decreasing sizes from the end wall 23 to the end wall 22. Integral with the side wall 25 at its upper edge along substantially the entire length thereof, and extending downwardly and outwardly therefrom, is an elongated flange 26 which may be used to facilitate hanging the tray assembly 10. For example, the flange 26 may be slipped over the upper edge of a side wall of a tool chest or the like to hang the tray assembly 10 therefrom.

Figure 4:
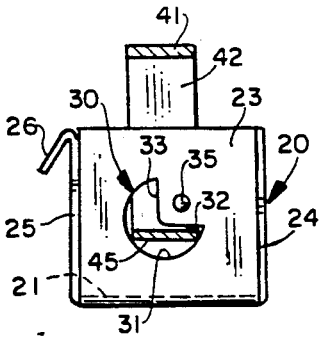
FIG. 4 is an enlarged view in vertical section taken along the line 4—4 in FIG. 3.
Figure 5:
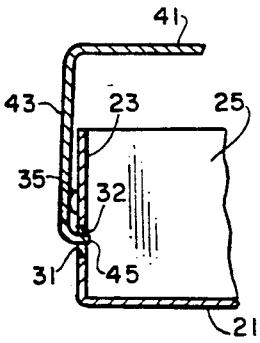
FIG. 5 is an enlarged, fragmentary view in vertical section taken along the line 5—5 in FIG. 2.
Figure 6:
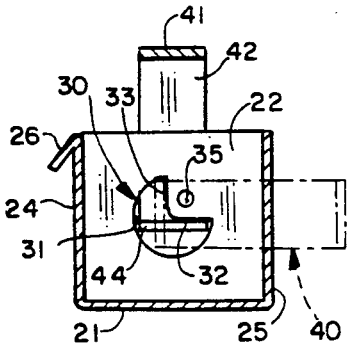
FIG. 6 is an enlarged view in vertical section taken along the line 6—6 in FIG. 3 and illustrating the access position of the retainer in phantom.

Each of the end walls 22 and 23 has formed therein generally centrally thereof an opening 30, the openings being of identical size and shape and being arranged as mirror images of each other. Referring in particular to FIGS. 4 and 6, each of the openings 30 is in the shape of a sector of a circle, having a part-circular edge 31 terminating at radial stop surfaces 32 and 33 disposed substantially perpendicular to each other, so that the sector of the opening 30 has an angular extent of substantially 270°. More specifically, the stop surfaces 33 are disposed substantially vertically, i.e., perpendicular to the bottom wall 21, while the stop surfaces 32 extend substantially horizontally from the stop surface 33 toward the side wall 24. Formed on each of the end walls 32 and 33 generally midway between the stop surfaces 32 and 33 is an outwardly projecting boss 35.

The tray assembly 10 also includes a bail retainer 40 which includes an elongated, flat, rectangular bight 41 having a length very slightly greater than the length of the bottom wall 21 and integral at its opposite ends with depending, flat, rectangular end portions 42 and 43 which extend from the bight 41 substantially perpendicular thereto. The end portions 42 and 43 are respectively provided a their distal ends with inwardly projecting rectangular tabs 44 and 45, extending toward each other generally parallel to the bight 41.

In use, the retainer 40 is dimensioned so that the end portions 42 and 43 thereof respectively extend along the outside of the end walls 22 and 23 of the receptacle 20. In this regard, the retainer 40 has sufficient flexibility for the end portions 42 and 43 to be spread sufficiently to permit the tabs 44 and 45 to be respectively inserted in the openings 30. Each of the tabs 44 and 45 has a width slightly less than the diameter of the associated opening 30 so that, when disposed therein, it forms a chord of the circular opening 30, as can best be seen in FIGS. 4 and 6.

Thus, it will be appreciated that the tabs 44 and 45 cooperate with the openings 30 to provide pivot joints accommodating pivotal movement of the retainer 40 between an upright retaining position, illustrated in solid line in FIGS. 1-5 and an access position, illustrated in phantom in FIGS. 1 and 6. During this pivotal movement, the side edges of the tabs 44 and 45 slide along the arcuate edges 31 of the openings 30, the pivotal movement being stopped by the stop surfaces 32 and 33 so that it is limited to a range of substantially 90°. More specifically, in the retaining position the pivotal movement of the retainer will be stopped by engagement of the tabs 44 and 45 with the stop surfaces 32, and in the access position pivotal movement will be stopped by engagement with the stop surfaces 33. The bosses 35 are so positioned that they are respectively engageable with the end portions 42 and 43 of the retainer 40 throughout its pivotal movement, so as to maintain a clearance between the end portions 42 and 43 and the receptacle end walls 22 and 23, as can best be seen in FIG. 5.

It will be appreciated that the lengths of the end portions 42 and 43 are such that, when the retainer 40 is in its retaining position, it closely overlies the receptacle 20, the clearance preferably being insufficient to permit removal of sockets 11 from the receptacle 20. Thus, the retainer 40 serves in this position to retain the sockets 11 in the receptacle 20. When the retainer 40 is in its access position, illustrated in FIGS. 1 and 6, it permits the sockets 11 to be removed from or inserted in the receptacle 20.

From the foregoing, it can be seen that there has been provided an improved socket tray which is of simple and economical construction and provides a pivoting retainer mounted without the use of fasteners and limited in pivotal movement between an access position and a retaining position.

I claim:

1. A tray assembly for articles comprising: an article receptacle having opposed upstanding end walls, each of said end walls having an opening therein with each of said openings shaped to define first and second stop surfaces, and a bail retainer having end portions respectively disposable along said end walls, each of said end portions having a projection extending therefrom such that said projections are respectively pivotally receivable in said openings for pivotal movement of said retainer between first and second positions, said retainer in its first position closely overlying said receptacle for retaining articles therein with said projections respectively engaged with said first stop surfaces, said retainer in its second position being disposed alongside said receptacle for permitting access to the interior thereof with said projections respectively engaged with said second stop surfaces, said first stop surfaces being positioned relative to said second stop surfaces so as to limit the pivotal movement of said retainer to substantially less than 360°.

2. The tray assembly of claim 1, wherein each of said openings is in the shape of a sector of a circle.

3. The tray assembly of claim 2, wherein each of said projections is a flat rectangular tab having a width slightly less than the diameter of the associated one of said openings so as to define a chord thereof when disposed therein.

4. The tray assembly of claim 2, wherein said first and second stop surfaces are disposed radially of said openings.

5. The tray assembly of claim 2, wherein said sector subtends an angle of substantially 270°.

6. The tray assembly of claim 1, wherein each of said projections is a flat rectangular tab.

7. The tray assembly of claim 1, wherein each of said projections is disposed at the distal end of the associated one of said end portions.

8. The tray assembly of claim 1, wherein said first and second stop surfaces are so disposed as to limit pivotal movement of said retainer to approximately 90°.

9. The tray assembly of claim 1, and further comprising flange means carried by said receptacle to facilitate hanging thereof on an associated support.

10. The tray assembly of claim 1, wherein each of said end portions extends along the outside of the associated one of said end walls, said end portions being sufficiently flexible to permit insertion of said projections in said openings.

11. A tray assembly for accommodating a plurality of sockets of varying diameter, comprising: an open-top receptacle having opposed upstanding end walls and opposed upstanding side walls, each of said end walls having an opening therein with each of said openings shaped to define first and second stop surfaces, a bail retainer having end portions respectively disposable along said end walls, each of said end portions having a projection extending therefrom such that said projections are respectively pivotally receivable in said opening for pivotal movement of said retainer between first and second positions, said retainer in its first position closely overlying said receptacle for retaining associated sockets therein with said projections respectively engaged with said first stop surfaces, said retainer in its second position being disposed alongside said receptacle for permitting access to the interior thereof with said projections respectively engaged with said second stop surfaces, said first stop surfaces being positioned relative to said second stop surfaces so as to limit the pivotal movement of said retainer to substantially less than 360°, and flange means on one of said side walls at the upper end thereof and extending outwardly and downwardly therefrom.

12. The tray assembly of claim 11, wherein said receptacle is generally trapezoidal in shape.

13. The tray assembly of claim 11, wherein said flange means extends substantially the entire length of said one of said side walls.

14. The tray assembly of claim wherein said retainer has an elongated flat bight portion, said end portions being respectively integral with said bight portion at the opposite ends thereof and extending therefrom substantially perpendicular thereto.

15. The tray assembly of claim 11, and further comprising spacer means carried by each of said end walls and engageable in use with the associated one of said end portions for maintaining a clearance between said end portions and said end walls.

16. The tray assembly of claim 15, wherein each of said spacer means is in the form of a boss on the associated side wall.

17. The tray assembly of claim 14, wherein said end portions are respectively disposed along the outside of said end walls, said retainer being sufficiently flexible to permit insertion of said projections in said openings.

18. The tray assembly of claim wherein each of said openings is in the shape of a sector of a circle.

19. The tray assembly of claim 18, wherein each of said projections is in the form of a flat tab having a width slightly less than the diameter of the associated one of said openings so as to define a chord thereof when inserted therein.

20. The tray assembly of claim 18, wherein each of said openings has an angular extent of substantially 270°.

* * * * *

UNITED STATES PATENT AND TRADEMARK OFFICE

CERTIFICATE OF CORRECTION

PATENT NO. : 5,195,636

DATED : March 23, 1993

INVENTOR(S) : Gerald A. Wridt

It is certified that error appears in the above-identified patent and that said Letters Patent is hereby corrected as shown below:

Column 5, line 5, after "claim" insert --11--.

Column 6, line 8, after "claim" insert --11--.

Signed and Sealed this

Sixteenth Day of November, 1993

*Attest:*

*Attesting Officer*

Bruce Lehman

BRUCE LEHMAN

*Commissioner of Patents and Trademarks*